US008543388B2

(12) United States Patent
Sandgren et al.

(10) Patent No.: US 8,543,388 B2
(45) Date of Patent: Sep. 24, 2013

(54) EFFICIENT SPEECH STREAM CONVERSION

(75) Inventors: Nicklas Sandgren, Luleå (SE); Jonas Svedberg, Luleå (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 955 days.

(21) Appl. No.: 12/095,709

(22) PCT Filed: Nov. 30, 2005

(86) PCT No.: PCT/SE2005/001800

§ 371 (c)(1),
(2), (4) Date: May 30, 2008

(87) PCT Pub. No.: WO2007/064256

PCT Pub. Date: Jun. 7, 2007

(65) Prior Publication Data

US 2010/0223053 A1 Sep. 2, 2010

(51) Int. Cl.
*G10L 19/00* (2013.01)

(52) U.S. Cl.
USPC ..... 704/219; 370/287; 370/323; 370/338; 370/466; 370/506; 375/242; 375/259; 379/102.01; 379/386; 455/414.1; 455/554.2; 455/67.11; 704/207; 704/227; 704/229; 704/230; 704/270

(58) Field of Classification Search
USPC ..... 704/227, 219, 207, 229, 230, 270; 455/67.14, 414.1, 554.2, 67.11; 370/287, 370/323, 338, 466, 506; 375/242, 259; 379/102.01, 386
See application file for complete search history.

(56) References Cited

U.S. PATENT DOCUMENTS

| | | | | |
|---|---|---|---|---|
| 4,545,052 | A * | 10/1985 | Steierman | 370/466 |
| 4,769,833 | A * | 9/1988 | Farleigh et al. | 379/102.01 |
| 4,885,746 | A * | 12/1989 | Fukushima et al. | 370/506 |
| 5,327,520 | A * | 7/1994 | Chen | 704/219 |
| 5,835,486 | A * | 11/1998 | Davis et al. | 370/287 |
| 5,949,822 | A * | 9/1999 | Hancharik | 375/242 |
| 5,991,639 | A * | 11/1999 | Rautiola et al. | 455/414.1 |
| 6,289,313 | B1 * | 9/2001 | Heinonen et al. | 704/270 |
| 6,510,407 | B1 * | 1/2003 | Wang | 704/207 |
| 7,212,511 | B2 * | 5/2007 | Jonsson et | 370/338 |
| 7,266,097 | B2 * | 9/2007 | Christodoulides et al. | 370/323 |
| 7,502,626 | B1 * | 3/2009 | Lemilainen | 455/554.2 |
| 2002/0077812 | A1 * | 6/2002 | Suzuki et al. | 704/230 |
| 2004/0174984 | A1 * | 9/2004 | Jabri et al. | 379/386 |

(Continued)

FOREIGN PATENT DOCUMENTS

| | | | |
|---|---|---|---|
| EP | 1288913 | A2 | 3/2003 |
| EP | 1564723 | A1 | 8/2005 |

*Primary Examiner* — Michael Colucci

(57) ABSTRACT

Speech frames of a first speech coding scheme are utilized as speech frames of a second speech coding scheme, where the speech coding schemes use similar core compression schemes for the speech frames, preferably bit stream compatible. An occurrence of a state mismatch in an energy parameter between the first speech coding scheme and the second speech coding scheme is identified, preferably either by determining an occurrence of a predetermined speech evolution, such as a speech type transition, e.g. an onset of speech following a period of speech inactivity, or by tentative decoding of the energy parameter in the two encoding schemes followed by a comparison. Subsequently, the energy parameter in at least one frame of the second speech coding scheme following the occurrence of the state mismatch is adjusted. The present invention also presents transcoders and communications systems providing such transcoding functionality.

50 Claims, 7 Drawing Sheets

(56) References Cited

U.S. PATENT DOCUMENTS

2004/0185785 A1* 9/2004 Mir et al. ..... 455/67.11
2004/0240566 A1* 12/2004 Sebire et al. ..... 375/259
2005/0091047 A1* 4/2005 Gibbs et al. ..... 704/219
2005/0137864 A1* 6/2005 Valve et al. ..... 704/227
2010/0161325 A1* 6/2010 Hellwig et al. ..... 704/229

* cited by examiner

EFFICIENT SPEECH STREAM CONVERSION

TECHNICAL FIELD

The present invention relates in general to communication of speech data and in particular to methods and arrangements for conversion of an encoded speech stream of a first encoding scheme to a second encoding scheme.

BACKGROUND

Communication of data like e.g. speech, audio or video data between terminals is typically performed via encoded data streams sent via a communication network. To communicate an encoded data stream from a sending terminal to a receiving terminal, the data stream is first encoded according to a certain encoding scheme by an encoder of the sending terminal. The encoding is usually performed in order to compress the data and to adapt it to further requirements for communication. The encoded data stream is sent via the communication network to the receiving terminal where the received encoded data stream is decoded by a decoder for a further processing by the receiving terminal. This end-to-end communication relies on that the encoder of the sending terminal and decoder of the receiving terminal are compatible.

A transcoder is a device that performs a conversion of a first data stream encoded according to a first encoding scheme to second a data stream, corresponding to said first data stream, but encoded according to a second encoding scheme. Thus, in case of incompatible encoder/decoder pairs in the sending/receiving terminals one or more transcoders can be installed in the communications network, resulting in that the encoded data stream can be transferred via the communication network to the receiving terminal, whereby the receiving terminal being capable of decoding the received encoded data stream.

Transcoders are required at different places in a communications network. In some communications networks, transmission modes with differing transmission bit rate are available in order to overcome e.g. capability problems or link quality problems. Such differing bit rates can be used over an entire end-to-end communication or only over certain parts. Terminals are sometimes not prepared for all alternative bit rates, which means that one or more transcoders in the communication network must be employed to convert the encoded data stream to a suitable encoding scheme.

Transcoding typically entails decoding of an encoded speech stream encoded according to a first encoding scheme and a successive encoding of the decoded speech stream according to a second encoding scheme. Such tandeming typically uses standardized decoders and encoders. Thus, full transcoding typically requires a complete decoder and a complete encoder. However, existing solutions of such tandeming transcoding, wherein all encoding parameters are newly computed, consumes a lot of computational power, since full transcoding is quite complex, in terms of cycles and memory, such as program ROM, static RAM, and dynamic RAM. Furthermore, the re-encoding degrades the speech representation, which reduces the final speech quality. Moreover, delay is introduced due to processing time and possibly a look ahead speech sample buffer in the second codec. Such delay is detrimental in particular for real- or quasi-real-time communications like e.g. speech, video, audio play-outs or combinations thereof.

Efforts have been made to transcode encoding parameters that represent the encoded data stream according to pre-defined algorithms, to directly form a completely new set of encoding parameters that represent the encoded data stream according to the second encoding scheme without passing the state of the synthesized speech. However, such tasks are complex and many kinds of artifacts are created.

In 3G (UTRAN) networks, the Adaptive Multi-Rate (AMR) encoding scheme will be the dominant voice codec for a long time. The "AMR-12.2" (according to 3GPP/TS-26.071) is an Algebraic Code Excited Linear Prediction (ACELP) coder operating at a bit rate of 12.2 kbit/s. The frame size is 20 ms with 4 subframes of 5 ms. A look-ahead of 5 ms is used. Discontinuous transmission (DTX) functionality is being employed for the AMR-12.2 voice codec.

For 2.xG (GERAN) networks, the GSM-EFR voice codec will instead be dominant in the network nodes for a considerable period of time, even if handsets capable of AMR encoding schemes very likely will be introduced. The GSM-EFR codec (according to 3GPP/TS-06.51) is also based on a 12.2 kbit/s ACELP coder having 20 ms speech frames divided into 4 subframes. However, no look-ahead is used. Discontinuous transmission (DTX) functionality is being employed for the GSM-EFR voice codec, however, differently compared with AMR-12.2.

For communication between the two types of networks, either decoding into the PCM domain (64 kbit/s) or a direct transcoding in the parameter domain (12.2 kbps) to and from AMR-12.2 and GSM-EFR, respectively, will thus be necessary.

A full transcoding (tandeming) in the GSM-EFR-to-AMR-12.2 direction will add at least 5 ms of additional delay due to the look-ahead buffer used for Voice Activity Detection (VAD) in the AMR algorithm. The actual processing delay for full transcoding will also increase the total delay somewhat.

Since the AMR-12.2 and GSM-EFR codecs share the same core compression scheme (12.2 kbit/s ACELP coder having 20 ms speech frames divided into 4 subframes) it may be envisioned that a low complexity direct conversion scheme could be designed. This would then open up for a full 12.2 kbit/s communication also over the network border, compared with the 64 kbit/s communication in the case of full transcoding. One possible approach could be based on a use of the speech frames created by one coding scheme directly by the decoder of the other coding scheme. However, tests have been performed, revealing severe speech artifacts, in particular the appearance of distracting noise bursts.

In the published U.S. patent application 2003/0177004, a method for transcoding a CELP based compressed voice bitstream from a source codec to a destination codec is disclosed. One or more source CELP parameters from the input CELP bitstream are unpacked and interpolated to a destination codec format to overcome differences in frame size, sampling rate etc.

In the U.S. Pat. No. 6,260,009, a method and apparatus for CELP-based to CELP-based vocoder packet translation is disclosed. The apparatus includes a formant parameter translator and an excitation parameter translator. Formant filter coefficients and output codebook and pitch parameters are provided.

None of these prior art systems discuss any remaining interoperability problems for codec systems having similar core compression schemes.

SUMMARY

A general problem with prior art speech transcoding methods and devices is that they introduce distracting artifacts, such as delays, reduced general speech quality or appearing noise bursts. Another general problem is that the required computational requirements are relatively high.

It is therefore a general object of the present invention to provide speech transcoding using less computational power while preserving quality level. In order words, an object is to provide low complexity speech stream conversion without subjective quality degradation. A further object of the present invention is to provide speech transcoding for direct conversion between parameter domains of the involved coding schemes, where the involved coding schemes use similar core compression schemes for speech frames.

The above objects are achieved by methods and arrangements according to the enclosed patent claims. In general words, speech frames of a first speech coding scheme are utilized as speech frames of a second speech coding scheme, where the speech coding schemes use similar core compression schemes for the speech frames, preferably bit stream compatible. An occurrence of a state mismatch in an energy parameter between the first speech coding scheme and the second speech coding scheme is identified, preferably either by determining an occurrence of a predetermined speech evolution, such as a speech type transition, e.g. an onset of speech following a period of speech inactivity, or by tentative decoding of the energy parameter in the two encoding schemes followed by a comparison. Subsequently, the energy parameter in at least one frame of the second speech coding scheme following the occurrence of the state mismatch is adjusted. The present invention also presents transcoders and communications systems providing such transcoding functionality. Initial speech frames are thereby handled separately and preferred algorithms and devices for improving the subjective performance of the format conversion are presented.

In particular embodiments, an efficient conversion scheme that can convert the AMR-12.2 stream to a GSM-EFR stream and vice versa is presented. Parameters in the initial speech frames are modified to compensate for state deficiencies, preferably in combination with re-quantization of silence descriptor parameters. Preferably, speech parameters in the initial speech frames in a talk burst are modified to compensate for the codec state differences in relation to re-quantization and re-synchronization of comfort noise parameters. In other particular embodiments, an efficient conversion scheme is presented offering a low complex conversion possibility for the G.729 (ITU-T 8 kbps) to/from the AMR7.4 (DAMPS-EFR) codec. In yet other particular embodiments, an efficient conversion scheme is presented offering a similar conversion between the PDC-EFR codec and AMR67.

The present invention has a number of advantages. Communication between networks utilizing different coding schemes can be performed in a low-bit-rate parameter domain instead of a high-bit-rate speech stream. For the AMR-12.2/GSM-EFR case, the Core Network (CN) may use packet transport of AMR-12.2/GSM-EFR packets (<16 kbps) instead of transporting a 64 kbps PCM stream.

Furthermore, the quality of the codec speech will be improved compared to tandem coded speech.

Moreover, there is a potential reduction of total delay since there is no need for any look-ahead buffer, e.g. in the EFR-to-AMR-12.2 conversion and that the processing delay will be less than the transcoding delay.

BRIEF DESCRIPTION OF THE DRAWINGS

The invention, together with further objects and advantages thereof, may best be understood by making reference to the following description taken together with the accompanying drawings, in which.

DETAILED DESCRIPTION

The present invention relates to transcoding between coding schemes having similar core compression scheme. By "core compression scheme" it is understood the type of basic encoding principle, the parameters used, the bit-rate, and the basic frame structure for assumed speech frames. In the exemplifying embodiments discussed below, the two coding schemes are AMR-12.2 (according to 3GPP/TS-26.071) and GSM-EFR (according to 3GPP/TS-06.51). Both these schemes utilize 12.2 kbit/s ACELP encoding. Furthermore, both schemes utilize a frame structure comprising 20 ms frames divided into 4 subframes. The bit allocation within speech frames is also the same. The bit stream of ordinary speech frames is thereby compatible from one coding scheme to the other, i.e. the two speech coding schemes are bit stream compatible for frames containing coded speech. In other words, frames containing coded speech are interoperable between the two speech coding schemes. However the two coding schemes have differing parameter quantizers for assumed non-speech frames. These frames are called SID-frames (SIlence Description). The coding schemes are therefore not compatible when SID frames are used. SID frames are used when VAD (Voice Activity Detection)/DTX (Discontinuous Transmission) is activated for a given coding scheme.

Another example of a pair of codecs having similar core compression scheme is the G.729 (ITU-T 8 kbps) codec and the AMR7.4 (DAMPS-EFR) codec, since they have the same subframe structure, share most coding parameters and quantizers such as pitch lag and fixed innovation codebook structure. Furthermore, they also share the same pitch and codebook gain reconstruction points. However, the LSP (Line Spectral Pairs) quantizers differ somewhat, the frame structure is different and the specified DTX functionality is different. Yet another example of a related coding scheme pair is the PDC-EFR codec and the AMR67 codec. They only differ in the DTX timing and in the SID transport scheme.

Also codecs having frames that differ somewhat in bit allocation or frame size may be a subject of the present invention. For instance, a codec having a frame length being an integer times the frame length of another related codec may also be suitable for implementing the present ideas.

Anyone skilled in the art therefore realizes that the principles of the present invention should not be limited to the specific codecs of the exemplifying embodiments, but may be generally applicable to any pair of codecs having similar core compression schemes.

Figure 1:
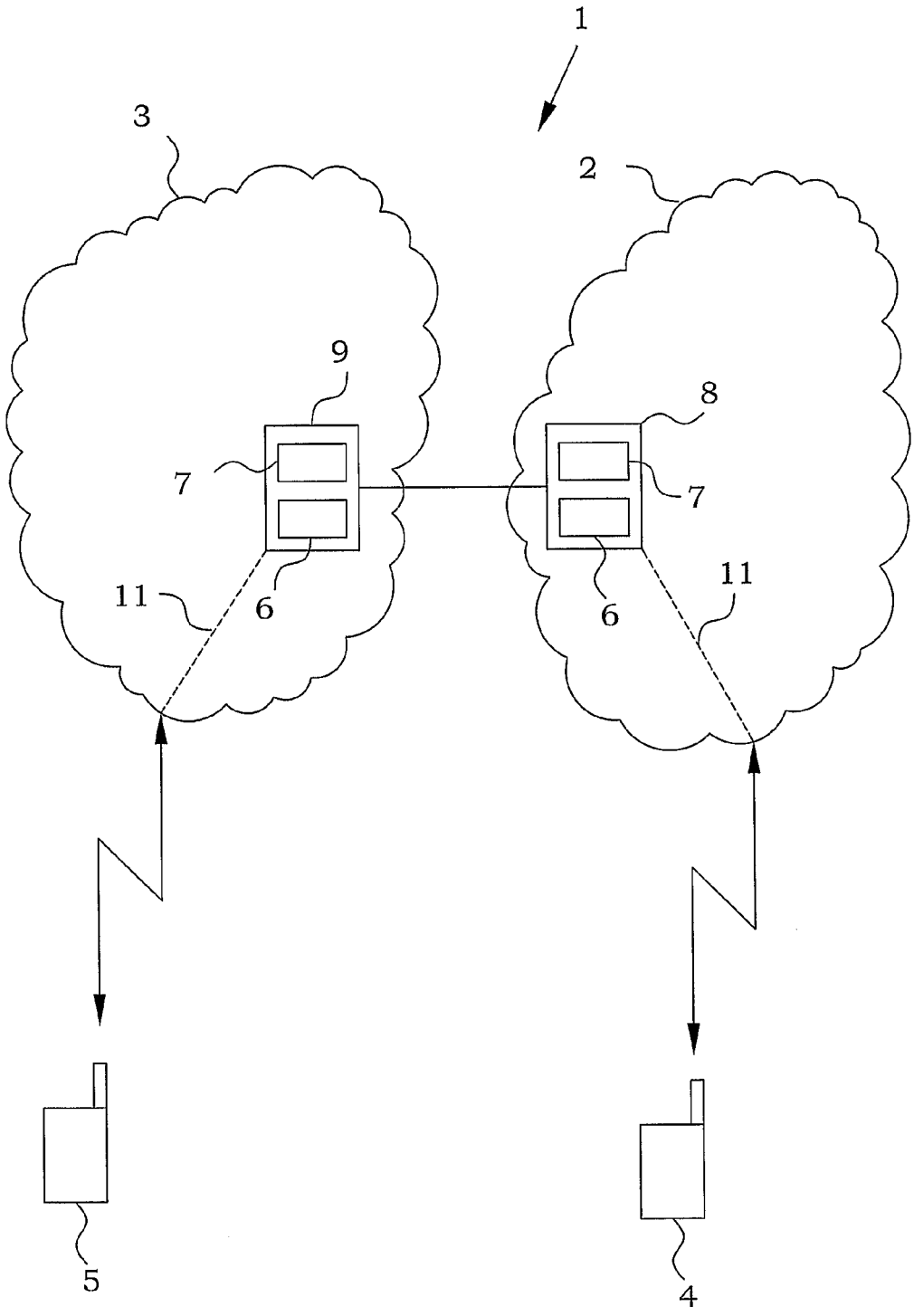
FIG. 1 is a schematic illustration of a communications system comprising transcoding functionality.

FIG. 1 illustrates a telecommunications system 1 comprising two communications networks 2 and 3. Communications network 3 is a 3G (UTRAN) network using AMR-12.2 voice codec. Communications network 2 is a 2.xG (GERAN) network, using GSM-EFR voice codec. When a terminal 4 adapted for communication in the communications network 2 should communicate with a terminal 5 adapted for communication in the communications network 3, a transcoding has to be performed somewhere along the communications path 11. A GSM-EFR-to-AMR-12.2 transcoder 6 and an AMR-12.2-to-GSM-EFR transcoder 7 may be located in an interface node 8 of communications network 2, which results in that speech coded according to AMR-12.2 is transferred between the two communication networks 2, 3. Alternatively, the transcoders 6, 7 may also be co-located in an interface node 9 of communications network 3, which results in that speech coded according to GSM-EFR is transferred between the two communication networks 2, 3. The transcoders 6 and 7 may also be located in a respective interface node 8, 9 or in both, whereby transmitted speech frames can be converted according to either speech coding scheme.

AMR is a standardized system for providing multi-rate coding. 8 different bit-rates ranging from 4.75 kbits/s to 12.2 kbit/s are available, where the highest bit-rate mode, denoted AMR-12.2, is of particular interest in the present disclosure. The Adaptive Multi-rate speech coder is based on ACELP technology. A look-ahead of 5 ms is used to enable switching between all 8 modes. The bit allocation for the AMR-12.2 mode is shown in Table 1.

For the LP analysis and quantization, two LP filters are computed for each frame. These filters are jointly quantized with split matrix quantization of 1st order MA-prediction LSF residuals.

TABLE 1

Bit allocation for AMR-12.2 and GSM-EFR frames.

| Parameter | Subframe 1 | Subframe 2 | Subframe 3 | Subframe 4 | Total |
|---|---|---|---|---|---|
| LSF | | | | | 38 |
| Adapt CB | 9 | 6 | 9 | 6 | 30 |
| Adapt gain | 4 | 4 | 4 | 4 | 16 |
| Alg CB | 35 | 35 | 35 | 35 | 140 |
| Alg gain | 5 | 5 | 5 | 5 | 20 |

The AMR-12.2 employs direct quantization of the adaptive codebook gain and MA-predictive quantization of the algebraic codebook gain. Scalar open-loop quantization is used for the adaptive and fixed codebook gains.

The AMR-12.2 provides also DTX (discontinuous transmission) functionalities, for saving resources during periods when no speech activity is present. Low rate SID messages are sent at a low update rate to inform about the status of the background noise. In AMR-12.2, a first message "AMR SID_FIRST" is issued, which does not contain any spectral or gain information except that noise injections should start up. This message is followed up by an "AMR SID_UPDATE" message containing absolutely quantized LSP's and frame energy. "AMR SID_UPDATE" messages are subsequently transmitted every 8th frame, however, unsynchronized to the network superframe structure. When speech coding is to be reinitiated, the speech gain codec state is set to a dynamic value based on the comfort noise energy in the last "AMR SID_UPDATE" message.

GSM-EFR is also a standardized system, enhancing the communications of GSM to comprise a bit-rate of 12.2 kbit/s. The GSM-EFR speech coder is also based on ACELP technology. No look-ahead is used. The bit allocation is the same as in AMR-12.2, shown in Table 1 above.

Also the GSM-EFR provides DTX functionalities. Also here, SID messages are sent to inform about the status, but with another coding format and another timing structure. After the initial SID frame in each speech to noise transition, a single type SID frame is transmitted regularly every 24th frame, synchronized with the GERAN super frame structure. The speech frame LSP, and gain quantization tables are reused for the SID message, but delta (differential) coding of the quantized LSP's and the frame gains are used for assumed non-speech frames. When speech coding is to be reinitiated, the speech gain codec state is reset to a fixed value.

As seen from the above, the similarities between the AMR-12.2 and the GSM-EFR codecs are striking. The core compression schemes of the AMR-12.2 speech coding scheme and the GSM-EFR speech coding scheme are bit stream compatible, at least for frames containing coded speech. However, there are differences which have to be considered in a transcoding between the two codecs. The Comfort Noise (CN) spectrum and energy parameters are quantized differently in GSM-EFR and AMR-12.2. As mentioned above, an EFR SID contains LSPs and code gain, both being delta quantized from reference data collected during a seven frame DTX hangover period. An AMR SID_UPDATE contains absolutely quantized LSPs and frame energy, while an AMR SID_FIRST does not contain any spectral or gain information, it is only a notification that noise injections should start up.

Another important difference is the different code gain predictor reset mechanisms during DTX periods. The GSM-EFR encoder resets the predictor states to a constant, whereas the AMR encoder sets the initial predictor states depending on the energy in the latest SID_UPDATE message. The reason for this is that lower rate AMR modes do not have enough bits for gain quantization of initial speech frames if the state is reset in the GSM-EFR manner.

In GSM-EFR to AMR-12.2 conversion, in order to transcode the delta quantized GSM-EFR CN parameters, they must first be decoded. The transcoder must thus include a complete GSM-EFR SID parameter decoder. No synthesis is needed though. The decoded LSFs/LSP's can then directly be quantized with the AMR-12.2 quantizer. To convert from GSM-EFR CN gain to the AMR CN frame energy, it is also necessary to estimate the LPC synthesis filter gain.

At test performed for investigating the interoperability between GSM-EFR and AMR-12.2, distracting noise bursts were discovered. These distracting noise bursts mainly appeared at the beginning of talk, e.g. at the end of a DTX period. It was thus concluded that the major problem with transcoding from GSM-EFR to AMR-12.2 is the different code gain predictor state initialization. The AMR-12.2 predictor is always initialized to an equal or greater value than GSM-EFR during DTX. Only when the remote encoder comfort noise level is low enough, they are initialized to the same value.

Figure 2A:
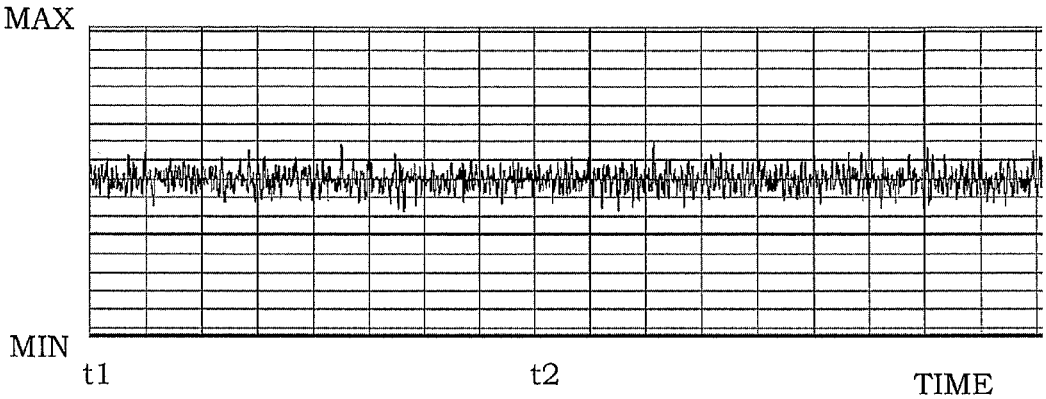
FIGS. 2A and B are diagrams illustrating decoded frames.
Figure 2B:
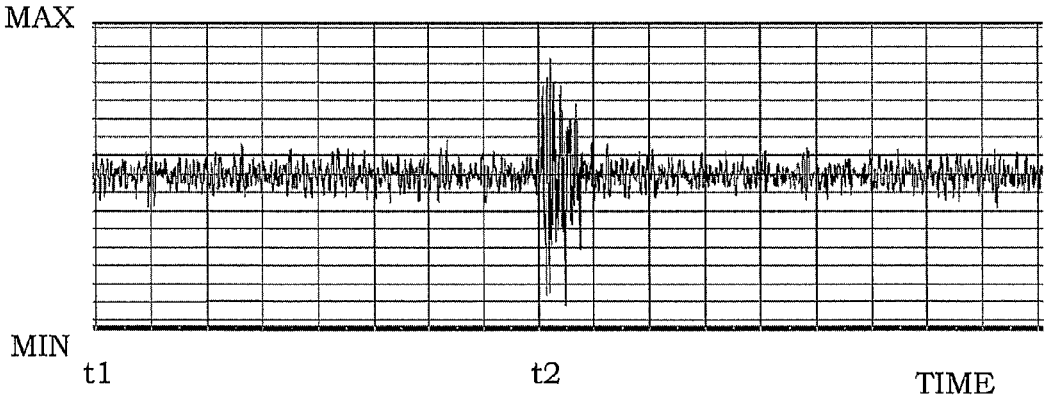

FIGS. 2A and 2B illustrate a course of events of signals. FIG. 2A represents a speech signal encoded and decoded according to the GSM-EFR encoding scheme, i.e. normal EFR encoding followed by normal EFR decoding. A speech signal has been present. At a time t1, a period of silence, i.e.

a noise only segment, begins. The GSM-EFR encoding initiates the DTX procedure by issuing SID messages. In the middle of the noise segment a single frame is classified as a speech frame. At time t2, the frame type determined by the encoder's Voice Activity Detection Algorithm thus indicates that the frame contains ordinary speech, however, no actual speech is present in the acoustic waveform. The indication of a speech start at t2 causes the ordinary GSM-EFR encoding to be reinitiated.

FIG. 2B shows the energy burst that will occur if normal EFR encoding is followed by normal AMR122 decoding for the same noise segment. FIG. 2B thus represents an identical signal as in FIG. 2A, also encoded according to the GSM-EFR, however, now decoded according to the AMR-12.2 encoding scheme adjusted to be conformed with the GSM-EFR DTX functionality. The speech signal as such during continuous speech coding, i.e. before time t1 is correctly decoded. During the silence period, the decoded signal depends on the particular SID arrangement adjustments that are performed, but will relatively easily give reasonable background noise levels, as seen in FIG. 2B. However, just at the indication of speech, i.e. at time t2, there occurs a large energy burst, after which the decoded signal returns to more accurate levels, corresponding to the ones achieved by the GSM-EFR decoding itself. This energy burst is indeed connected to the occurrence of a first speech frame following a silence period.

Figure 4A:
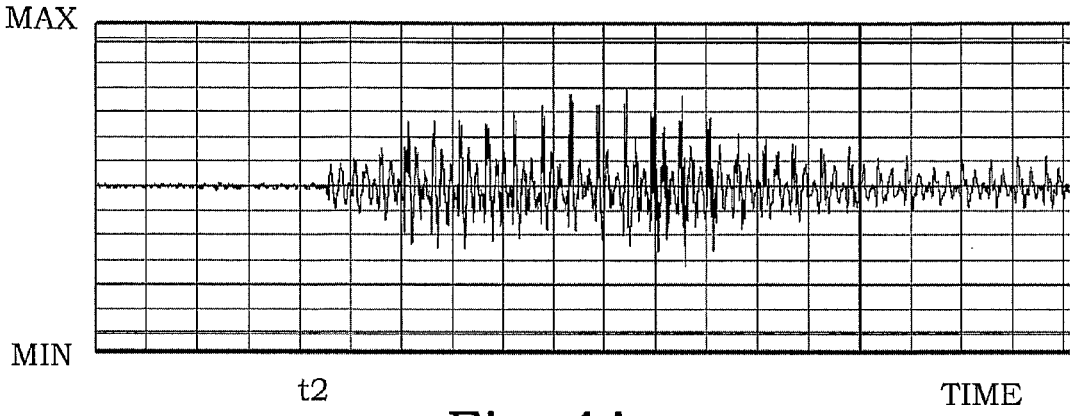
FIGS. 4A-C are diagrams illustrating examples of decoded speech.
Figure 4B:
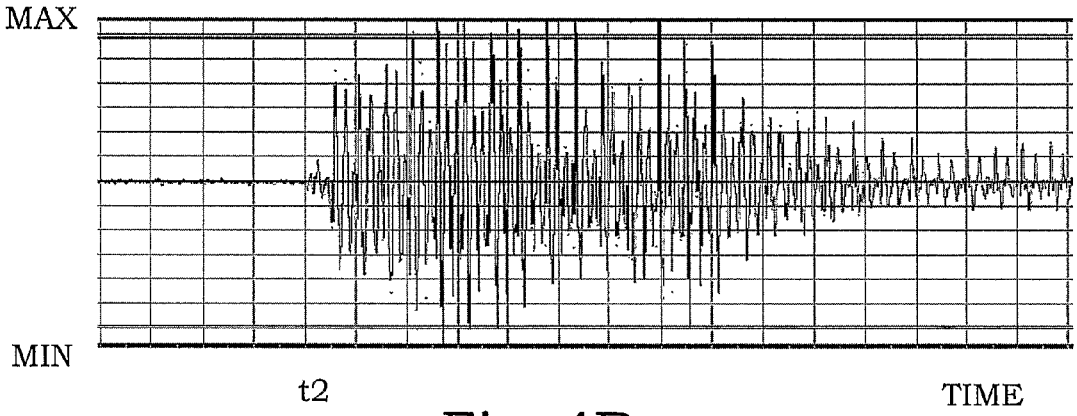

A similar situation is depicted in FIGS. 4A and 4B illustrating examples of an onset of speech when using different interoperation between codec schemes. In FIG. 4A, the onset at time t2 of speech is illustrated as encoded and decoded by GSM-EFR. In FIG. 4B, the corresponding signal is encoded by GSM-EFR but decoded according to AMR-12.2 without any further modifications. The result of the different initialization schemes is that the de-quantized code gain for the initial, e.g. first four, sub-frames in a talk burst, i.e. first frame, will be too high unless the CN (Comfort Noise) level was low enough. This can be seen in FIG. 4B as a saturation of the signal. In the worst observed case during the tests, the decoded gain was as much as 18 times (25 dB) too high, resulting in very loud, disturbing and occasionally detrimental sound spikes.

The worst case occurs when the GSM-EFR encoder input background noise signal has quite high energy so that the AMR-12.2 predicted value will based on the state value "0". The state is derived from converted GSM-EFR SID information. The GSM-EFR predictor state value is "−2381", which is achieved from the GSM-EFR reset in the first transmitted SID frame.

The acoustic effect of this state discrepancy is often that a small about 10 ms long noise burst, a "blipp", see FIG. 2B, is heard in the AMR-12.2 synthesis. However, occasionally when the first speech subframe contains voiced speech, the effect is almost an explosion, causing synthesis filter saturation, as in FIG. 4B, and a synthesis that potentially even is detrimental to the listener's ear. Both of these effects are unacceptable from a voice quality point of view.

In transcoding in the other direction, AMR-12.2 to GSM-EFR, the gain difference will be in the opposite direction. The gain values will then be reduced in the first frame, but will be correct in the first subframe of the second frame. The result is a dampened onset of the speech, which is also undesired. The AMR-12.2 to GSM-EFR synthesis has lower start-up amplitude but the waveform is still matching the GSM-EFR synthesis quite well.

When having realized that the cause of distracting speech artifacts has its origin in an occurrence of a state mismatch in an energy parameter, such as the gain factor in the above embodiment, actions can be taken. First, the occasions when a state mismatch occurs should be identified. Secondly, when such mismatch occurs, the energy parameter should be adjusted to reduce the perceivable artifacts. Such adjustments should preferably be performed in one or more frames following the occurrence of the state mismatch.

The occurrence of a state mismatch may be identified in different ways. One approach is to follow the evolution of the speech characteristics and identify when a predetermined speech evolution occurs. The predetermined speech evolution could e.g. a speech type transition as in the investigated case above. The particular case discussed above can be defined as a predetermined speech evolution of an onset of speech following a period of speech inactivity.

Figure 3:
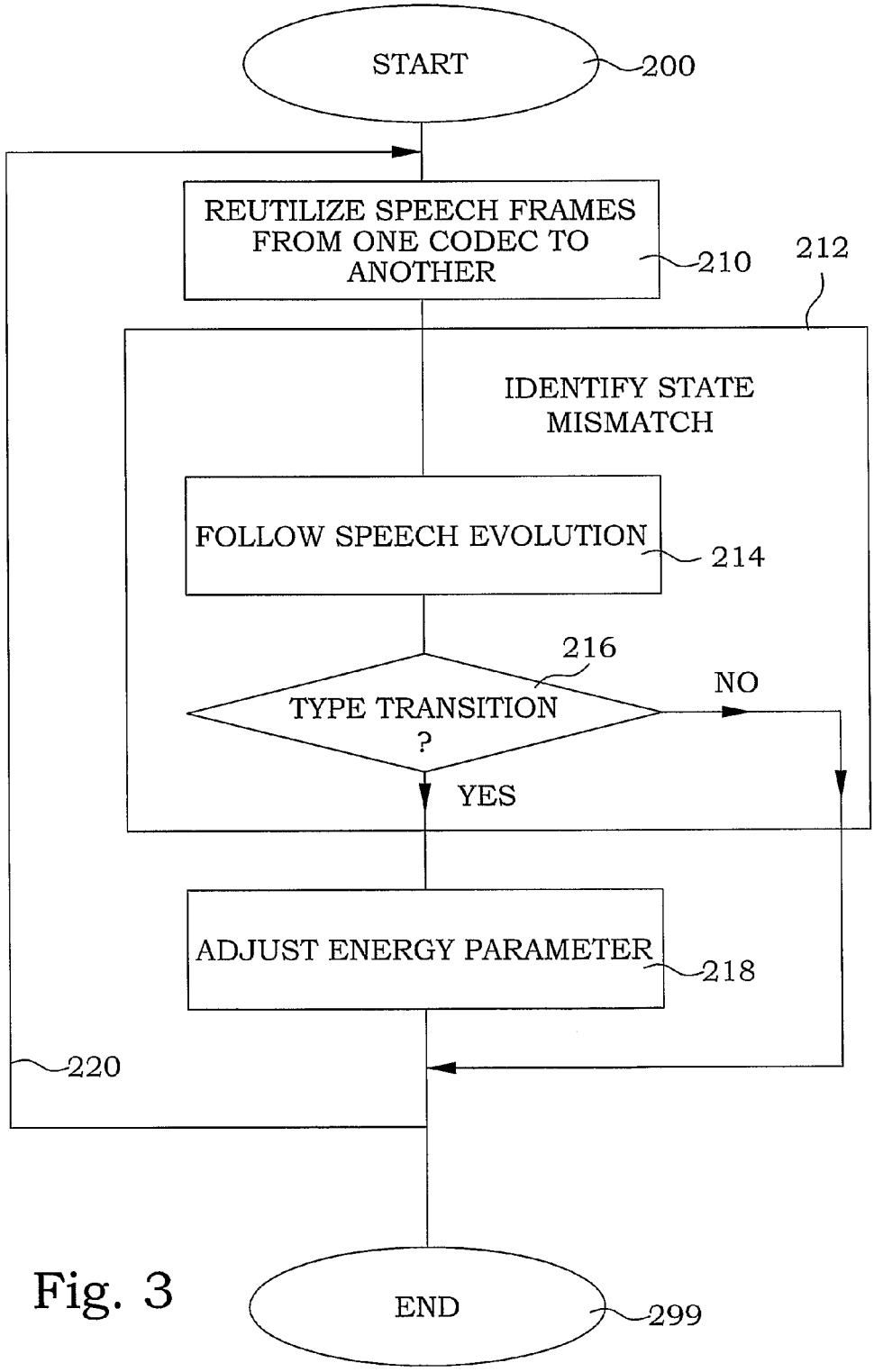
FIG. 3 is a flow diagram of main steps of an embodiment of a method according to the present invention.

FIG. 3 is a flow diagram illustrating main steps of an embodiment of a method according to the present invention. The procedure starts in step 200. In step 210, speech frames of a first speech coding scheme are utilized as speech frames of a second speech coding scheme. The first speech coding scheme and the second speech coding scheme use similar core compression schemes for speech frames. In step 212, an occurrence of state mismatch in an energy parameter between said first speech coding scheme and said second speech coding scheme is identified. The step 212 comprises in the present embodiment further part steps 214 and 216. In step 214, the evolution of the speech is followed. In step 216, it is determined whether a predetermined speech evolution, e.g. a predetermined speech type transition has occurred or not. In particular, an onset of speech following a period of speech inactivity may be detected. If the predetermined speech evolution is not found, the procedure is ended or repeated as described below. If the predetermined speech evolution is found, the procedure proceeds to step 218. In step 218, the energy parameter is adjusted in at least one frame following the occurrence of the state mismatch in frames of the second speech coding scheme. The procedure ends in step 299. In practice, the procedure is repeated as long as there are speech frames to handle, which is indicated by the arrow 220.

The occurrence of a state mismatch can also be detected by more direct means. The energy parameter of the speech encoded by a first speech coding scheme can be decoded. Likewise, the energy parameter of the speech using the second coding scheme can be decoded. By comparing the energy parameters obtained in this way, a too large discrepancy indicates that a state mismatch is present. An adjustment of gain may then be performed continuously for every subframe until the detected state mismatch is negligible.

Assume that the state mismatch is detected by monitoring an initiation of speech after a speech inactivity period. Further assume a transcoding from GSM-EFR to AMR-12.2. One solution of adjusting the gain would then be to modify the code gain parameters in the first couple of speech frames in each talk burst, until the AMR-12.2 decoder gain predictor states have converged with the GSM-EFR encoder states. To do this, the transcoder must keep track of both the GSM-EFR and the AMR-12.2 predictor states. In a speech quality point of view the best method is then to calculate new code gain parameter for AMR-12.2 with the criteria that the de-quantized gain should be equal to the de-quantized gain in a hypothetical GSM-EFR decoder. Experiments show that typically between 2 and 5 speech frames need to be adjusted before the AMR-12.2 predictor converges and is equal to the GSM-EFR predictor.

This method will give the AMR-12.2 decoder an almost perfect gain match to GSM-EFR. However due to quantizer saturation, a slight mismatch might still occur. This typically happens in the second subframe in a talk spurt if the gain quantizer was saturated in the first subframe and the previous CN level was high enough. The code gain for the first AMR-12.2 subframe will then be significantly lowered due to the higher values in the predictor. This low value is then shifted into the predictor memory in the AMR-12.2 decoder, but the hypothetical GSM-EFR decoder on the other hand shifts in a max value (quantizer saturated). Then in the second subframe AMR-12.2 suddenly has lower prediction since the newest value in the predictor memory has the highest strength. If the gain parameter of the second subframe then is too high, new AMR-12.2 gain parameter will be saturated as the transcoder tries to compensate for the predictor mismatch. Hence the decoded code gain will be too low.

This quantization saturation effect is hardly noticeable, but a possible improvement would be to calculate the AMR code gains for two or more subframes at the same time, and then be able to get the total energy correct for a longer integration period.

The above "almost perfect" match of the gain requires that predictor states of both speech coding schemes are monitored. In a large majority of cases, less sophisticated but suboptimal solutions are available. In one embodiment, the code gain index is simply adjusted by a predetermined factor in the index domain. In experiments it has been tested to just divide the energy parameter for the first sub frame by two to get rid of the over-prediction, i.e. the energy parameter is reduced by 50% in the index domain. A bit domain manipulation may then ensure a considerable reduction of the gain, and this manipulation may in most cases be enough. A reduction of the energy parameter index by a factor $2^n$, where n is an integer >0, is easily performed on the encoded bit stream. In practice, such a simplified gain conversion algorithm was indeed found to work with very little quality degradation compared to the ideal case.

Another index domain approach would be to always reduce the first gain index value with at least ~15 index steps, corresponding to approximately a state reduction of −22 dB. Even setting the energy parameter to zero would be possible, whereby said first frame after said occurrence of state mismatch is suppressed.

Another approach is to just drop the first speech frame in each talk burst. If the GSM-EFR gain predictor state is initialized with a small value, the gain indices in the first incoming speech frame will normally be quite high. The result is a higher predicted gain for the second speech frame than for the first. Thus, by dropping the complete first speech frame for the AMR-12.2 stream, the AMR-12.2 decoder will have too low instead of too high predicted gain for its first speech frame, i.e. for the second GSM-EFR speech frame.

Such an approach will have a considerable effect on the waveform for the first 20 ms. Surprisingly enough, the subjective degradation of the speech is quite low. The initial voiced sound in each talk-spurt does, however, loose somewhat of its 'punch'.

The adjusting procedure may also comprise a change of the energy parameter based on an estimate based on comfort noise energy during frames preceding the occurrence of the state mismatch. The adjustment could also be made dependent on external energy information.

The timing of the adjusting step may also be implemented according to different approaches. Typically, the first frame after the occurrence of the state mismatch is adjusted. The adjusting step can however be performed separately for every subframe, or commonly for the entire frame. The reduction of code gain by predetermined index factors are preferably made in the first one or two frames, e.g. to quickly get the predicted gain in the AMR-12.2 decoder down. However, in more sophisticated approaches, measurements of the actual gain mismatch may determine when the adjusting step is skipped.

The above discussions have been made assuming a transcoding from GSM-EFR to AMR-12.2. The same principles are in principle valid also for a transcoding from AMR-12.2 to GSM-EFR. In such cases, a reduction of the energy parameter is typically not useful, since the energy parameter of GSM-EFR underestimated. The GSM-EFR predictor is always initialized to a smaller or equal value than the AMR-12.2, and the predicted gain will therefore always be smaller or equal. The effect is that the decoded gains for the first speech frame in a talk spurt will be too low. Such degradation is in most cases hardly noticeable in a single conversion case.

Even if it might not be necessary, it would indeed be possible to improve the transcoding by adjusting code gain in the first speech frames also for transcoding from AMR-12.2 to GSM-EFR. Any direct adjustments in the index domain will in such a case result in an increase of the gain index.

Figure 4C:
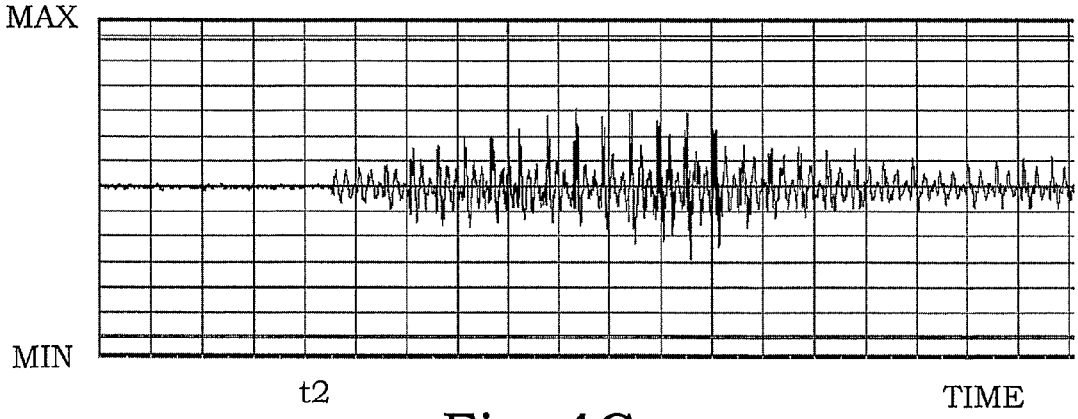

FIG. 4C illustrates a typical course of events, when the present invention is applied. The same signal as in FIGS. 4A and 4B is provided. FIG. 4C represents an identical speech signal as in FIG. 4A, also encoded according to the GSM-EFR, however, now decoded according to the AMR-12.2 encoding scheme adjusted to be conformed to the GSM-EFR DTX functionality and including the above gain adjustment routines according to the present invention. It is easily seen that the onset of the talk is reconstructed in a much more reliable manner than the case of FIG. 4B. The gain was adjusted by reducing the gain index by a factor of 2, in the first subframe of the first speech frame after a silence period.

Since the speech frame bit-streams for GSM-EFR and AMR-12.2 are interoperable and the gain problems at the onset of activity periods can be solved by the above described approach, an effective conversion can be achieved. The remaining large discrepancy between the two codec schemes concerns the SID information. However, a transcoding of SID information, preferably in the parameter domain for SID frames is possible to perform, as well as an adjustment of the timing of the SID information, i.e. SID-quantization (rate) and occasion.

Figure 5A:
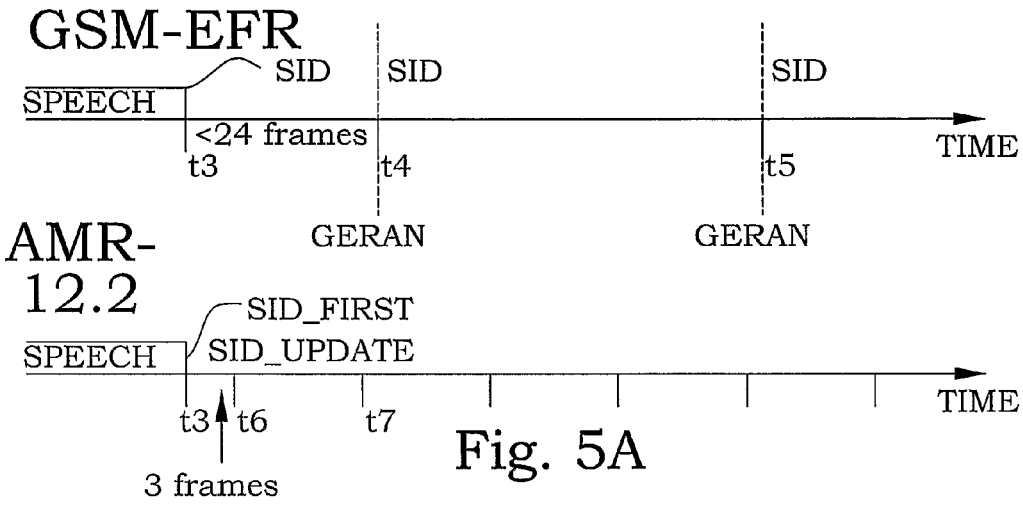
FIG. 5A is a time diagram illustrating SID structures during DTX in GSM-EFR and AMR-12.2, respectively.

FIG. 5A illustrates in the upper part a time diagram for a DTX period of a GSM-EFR coding. Speech is present until a time t3. The GSM-EFR encoder then marks the start of the DTX period with a first SID frame directly after the last speech frame. The regular SID frames are transmitted with a period of 24 frames, synchronized with the GERAN air interface measurement reports. The GERAN air interface measurement reports occur in FIG. 5A at times t4 and t5. This means that the time between the first SID frame and the second SID (regular SID) is sent may vary between 0 and 23 frames, depending on the detection instant for the speech end and the GERAN synchronization. The remote SID-synchronization is performed using a state flag called TAF (Time Alignment Flag).

In the lower part of FIG. 5A, a time diagram for a DTX period of an AMR-12.2 coding is illustrated. The AMR-12.2 codec transmits an initial SID_FIRST frame immediately after the detection of the end of speech at time t6. Then, 3 frames later, at time t7, a SID_UPDATE frame is transmitted. SID_UPDATE frames are thereafter repeated every 8th frame.

When performing a transcoding between the two coding schemes illustrated in FIG. 5A, it is necessary to perform a conversion of SID message rate and timing. In other words, the transcoding involves the functionality to convert silence description parameters in silence description frames of a first speech coding scheme to silence description parameters in silence description frames of a second speech coding scheme.

Figure 5B:
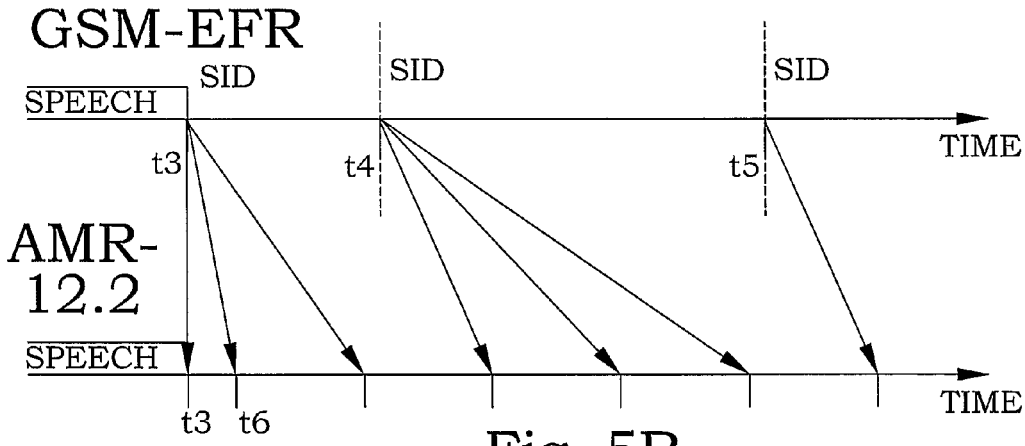
FIG. 5B is a time diagram illustrating conversion of SID structures during DTX for a transcoding from GSM-EFR to AMR-12.2.

First consider the transcoding from GSM-EFR to AMR-12.2. This is schematically illustrated in FIG. 5B. The incoming speech is coded according to the upper time line. A SID frame occurs at time t3, due to a transition from speech to background noise. Later additional regular SID frames occur at times t4 and t5, as decided by the GERAN. At time t3, the first indication of the DTX period is received by the reception of an initial GSM-EFR SID frame. The content of the GSM-EFR SID frame is stored and an AMR SID_FIRST frame is generated according to the AMR-12.2 coding scheme. Due to the faster comfort noise update rate in AMR-12.2, the conversion algorithm must have its own AMR noise update synchronization state machine. A SID_UPDATE frame of the AMR-12.2 is thus created 3 frames after the SID_FIRST frame, at time t6. The SID parameters from the initial GSM-EFR SID are converted and transmitted in the SID_UPDATE frame. A simple solution for the further AMR-12.2 SID_UPDATE frames is to continuously save the SID parameters from the latest received GSM-EFR SID and repeat them whenever an AMR-12.2 SID_UPDATE frame should be sent.

This method will, however, result in a slightly less smooth energy contour for the transcoded AMR-12.2 Comfort Noise than what would have been provided by a GSM-EFR decoder. The reason is due to the parameter repetition and the parameter interpolation in the decoder. The effect is hardly noticeably, but could potentially be defeated by filtering the energy parameter in the AMR-12.2 SID_UPDATE frames and thereby creating a smoother variation.

Figure 5C:
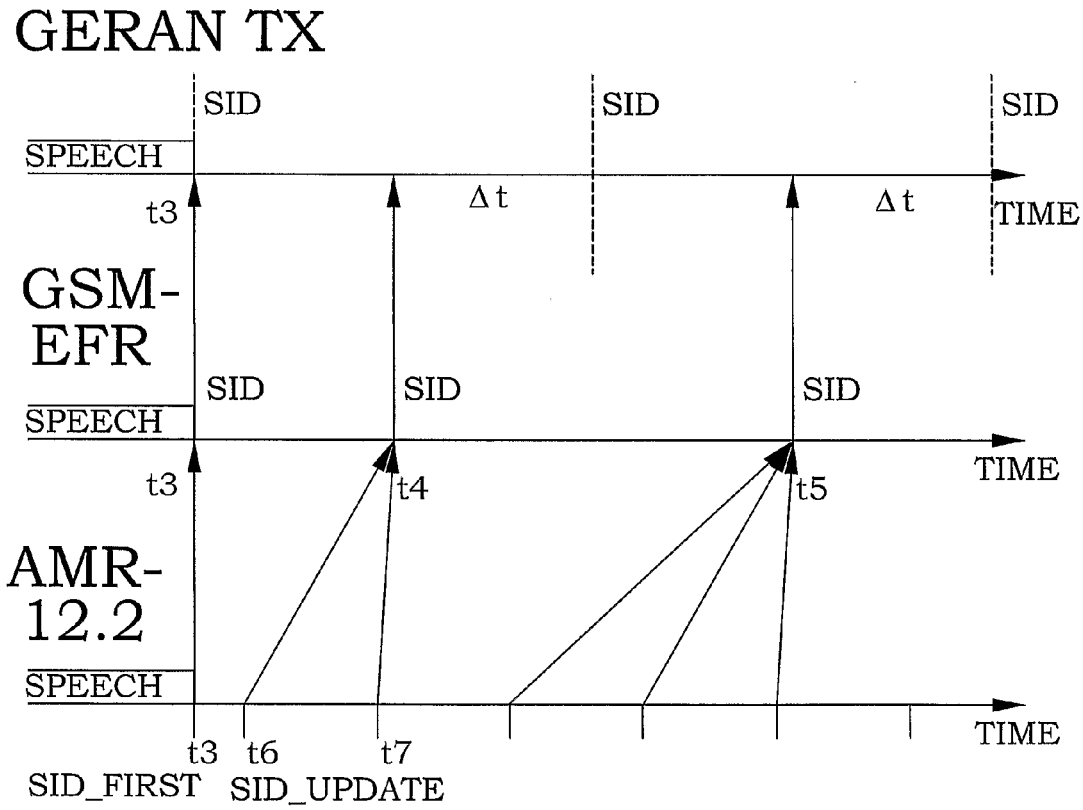
FIG. 5C is a time diagram illustrating conversion of SID structures during DTX for a transcoding from AMR-12.2 to GSM-EFR.

Now, instead consider the transcoding from AMR-12.2 to GSM-EFR. This is schematically illustrated in FIG. 5C. The incoming speech is coded according to the lower time line. A SID_FIRST frame occurs at time t3, at the end of the speech. This is the indication of the start of the DTX period.

To be able to delta quantize the GSM-EFR SID parameters, the transcoder needs to calculate the CN references from the DTX hangover period in the same way as the GSM-EFR decoder. This implies updating an energy value and the LSF history during speech periods and having a state machine to determine when a hangover period has been added. Unfortunately from a complexity point of view, in the normal operation case, the energy value that is in use between SID_FIRST and SID_UPDATE is based on the AMR-12.2 synthesis filter output (before post filtering). Thus the AMR-12.2 to GSM-EFR conversion needs to synthesize non-post filtered speech values to update its energy states. Alternatively, these energy values may be estimated based on knowledge of the LPC-gain, the adaptive codebook gain and the fixed codebook gain. Furthermore, the AMR-12.2 Error Concealment Unit uses the synthesized energy values to update its background noise detector.

The AMR-12.2 SID_UPDATE energy can be converted to GSM-EFR SID gain by calculating the filter gain. Since there are no CN parameters transmitted within the SID_FIRST frame, the transcoder must calculate CN parameters for the first GSM-EFR SID the same way the AMR-12.2 decoder does when a SID_FIRST is received. The SID_FIRST frame can then be converted to an initial GSM-EFR SID frame. Thus, silence descriptor parameters for an incoming AMR-12.2 SID_FIRST frame are estimated and the estimated silence descriptor parameters are quantized into a first GSM-EFR silence description. The creation of the very first GSM-EFR SID in the session starts a local TAF counter. The actual GERAN air interface transmission of the first GSM-EFR SID frames will be synchronized with the remote GERAN TAF by functionality in the remote downlink transmitter. The remote downlink transmitter is responsible for storing the latest SID frame and transmitting it in synchronization with the real remote TAF (in synchronization with the measurement reports). Since the transcoder, TAF isn't generally aligned with the remote GERAN TX TAF, a delay Δt arises at the receiving terminal for the GSM-EFR SIDs that are transmitted based on the local TAF. In the worst case the regular SIDs can be delayed up to 23 frames before transmission.

The successive SID_UPDATE's cannot be directly converted, instead the latest SID parameters (spectrum and energy) are stored. The transcoder then keeps a local TAF counter to determine when to quantize the latest parameters and create a new GSM-EFR SID. Finally, the quantization of the latest stored received silence description parameters is performed to be included in a new GSM-EFR silence description frame.

Another aspect of the invention is discussed below. Here, the energy level of noise is a problem due to a mismatch in CN reference vectors states. However, this aspect also utilizes an identification of state mismatch and an adjustment, according to the basic principles. The target of this particular embodiment is to correct the Comfort Noise level rather than the synthesized speech. These problems typically occur if a conversion is started some time after a call has begun. By such an asynchronous start-up it is not guaranteed to construct a CN reference vector before having to convert SID frames. Almost the same problems will occur for conversion in both directions.

The severity of the asynchronous startup depends to a very large extent on how often the conversion algorithm will be reset. If the conversion algorithm is reset for every air interface handover, the problem situation will occur frequently and the problems will be considered as severe. If the reset on the other hand only is performed e.g. for source signal dependent reasons the degradation will probably be considered as negligible. This could e.g. be every time a DTMF tone insertion is performed.

First, the issue of starting up the transcoding during speech is addressed. If the talk burst, being present at the occasion when the transcoding is starting, continues so long that the CN reference vector can be updated then there is no problem. Otherwise the problem will be the similar as for startup during DTX periods, described further below. With an assumed average Voice Activity Factor (VAF) of 50% this would be as common as the start-up during silence or background noise.

Now, turning to the startup during DTX periods or background noise periods. This is the case present when the initial sequence of frames arriving into the transcoder is an arbitrary number of NO_DATA followed by a regular SID or SID_UPDATE frame. When the first regular SID or SID_UPDATE frame arrives to the transcoder, the GSM-EFR CN reference vector will still be in its initial state, resulting in that the transcoded SID (e.g. GSM-EFR or AMR-12.2) will get very low gain, or energy in the AMR-12.2 case. The same condition is present for all consecutive SID frames that are transcoded until a speech period have passed, long enough for the GSM-EFR CN reference vector to be updated.

There are a couple of approaches for solving this problem. One possibility is to not transcode any SID information until the CN reference vector indeed has been updated. If the decoder doesn't receive any SIDs, it will continue to generate noise from previously received data before entering the DTX muting state. In the AMR-12.2 to GSM-EFR case, this method can hold up the noise level up to 480 ms longer before muting occurs. On the other hand, this method will mute to dead silence whereas an erroneous SID's would at least leave a very low noise floor. The GSM-EFR to AMR-12.2 transcoding will behave in a similar way.

Another approach is to combine the above presented approach with a SID transcoding. If the initial input is NO_DATA or SIDs, one can wait approximately 400 ms for incoming speech frames without causing any muting. If one then starts to transcode the incoming SIDs, at least total muting of the background noise is avoided.

However, a foolproof way to ensure that the decoder indeed will synthesize the correct noise level is to generate speech frames until the decoder CN reference vector has been updated. This is straightforward for AMR-12.2 to GSM-EFR transcoding, either by decoding the SID frames or by peeking on the PCM stream, available in a TFO case, discussed more in detail below. At startup of a GSM-EFR to AMR-12.2 transcoder, it wouldn't have the CN reference vector to be able to decode the GSM-EFR CN data. Thus, peeking at the PCM stream is the only way for obtaining correct noise level reproduction.

For the TFO (Tandem Free Operation) case, a possible solution to alleviate the problems with asynchronous startup of the GSM-EFR decoder, and the GSM-EFR to AMR-12.2 converter is to transfer a subset of the RXDTX handler states from the GSM-EFR decoder to the GSM-EFR to AMR-12.2 converter. A similar transfer is also possible in the reverse direction (AMR-12.2 to GSM-EFR).

An observation on the original problem—speech energy bursts—due to the second problem—noise level—can be made. In a case where the initial sequence of frames into the transcoder is a low number of NO_DATA frames followed by a SPEECH frame, it is not possible to use an advanced code gain adjust algorithm since the transcoder doesn't know the gain predictor state of the coder and decoder. However by assuming the worst case and have the AMR predictor initialized to the maximum start values, it is possible to ensure that the decoded gain is at least lower than the target gain.

For the GSM-EFR to AMR-12.2 conversion, the problems with long silence intervals may be alleviated by achieving a warm-start TFO solution. Incoming data from the GERAN is then transported as a GSM-EFR-stream. The GSM-EFR to AMR-12.2 SID converter can then preferably start up using output TFO PCM-data from the GSM-EFR decoder. The minimum set of variables that are needed to warm-start the GSM-EFR to AMR-12.2 SID converter are the reference gain state, the synthesis gain and the gain used in GSM-EFR error concealment. For a complete, hot, start up, the LSF reference vector variables may be needed as well, together with the buffers for the reference gain and reference LSF's and the interpolation counter.

For the AMR-12.2 to GSM-EFR conversion, the situation is similar. Here, incoming data from UTRAN or GERAN is transported as an AMR-12.2-stream. The absolute CN-energy quantization for the AMR-12.2 SID_UPDATE frames should only make it necessary to transfer the variable indicating the end of a hangover period. Using the energy information in the SID_UPDATE frames makes it possible to set a reasonable estimate of the EFR-states. To improve the solution further one may also wait for the second AMR_SID_UPDATE to provide a somewhat safer energy estimate.

Figure 6A:
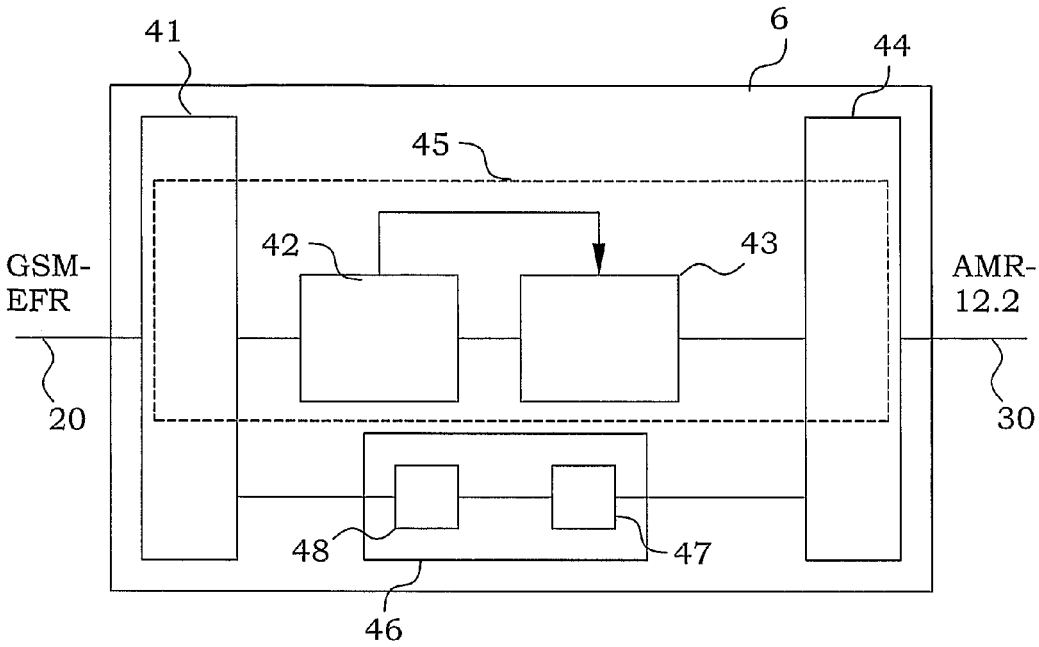
FIG. 6A is a block diagram of main parts of an embodiment of a transcoder from GSM-EFR to AMR-12.2.

FIG. 6A is a block diagram of main parts of an embodiment of a transcoder 6 from GSM-EFR to AMR-12.2. Frames encoded according to the GSM-EFR coding scheme are received at an input 20. The frames are analyzed in an input control section 41. All frames according to the GSM-EFR speech coding scheme are forwarded to an identifier 42 for identifying an occurrence of a state mismatch in the code gain according to the procedures discussed further above. The speech frames are forwarded to a gain adjuster section 43, in which the code gain parameters are adjusted, preferably according to one of the procedures discussed above. The gain adjustment is performed if a state mismatch is identified in the identifier 42, and lasts preferably during one or a few frames. The speech frames, possibly with adjusted gain parameters, are provided to an output control section 44, from which frames are transmitted on an output 30. These frames can according to the present invention be considered as encoded by the AMR-12.2 coding scheme. A means 45 for utilizing speech frames of the GSM-EFR speech coding scheme as speech frames of the AMR-12.2 speech coding scheme is thereby provided, as the identifier 42, the gain adjuster section 43 and at least parts of input control section 41 and the output control section 44.

If the identifier 42 utilizes the direct detection approach, the identifier in turn comprises a decoder for an energy parameter of speech encoded by the GSM-EFR speech coding scheme, a decoder of an energy parameter of the speech using the AMR-12.2 speech coding scheme and a comparator, connected to the decoders for comparing the energy parameters.

Preferably, the speech transcoder 6 also comprises a SID converter 46, also arranged to receive all frames from the input stream from the input control section 41. The SID converter 46 is arranged for converting a first GSM-EFR SID frame to an AMR-12.2 SID_FIRST frame. The SID parameters of a latest received GSM-EFR SID frame are stored in a storage 48 and utilized for conversion of SID parameters to an AMR-12.2 SID_UPDATE frame, whenever an AMR SID_UPDATE frame is to be sent. Preferably, the SID converter 46 additionally comprises a filter 47 for filtering the energy parameter of the AMR SID_UPDATE frame and a quantizer. The output control section 44 receives speech frames from the gain adjuster section 43 and AMR-12.2 SID (SID_FIRST, SID_UPDATE) frames from the SID converter 46. The output control section 44 further comprises timing control means and a generator for NO_DATA frames.

Figure 6B:
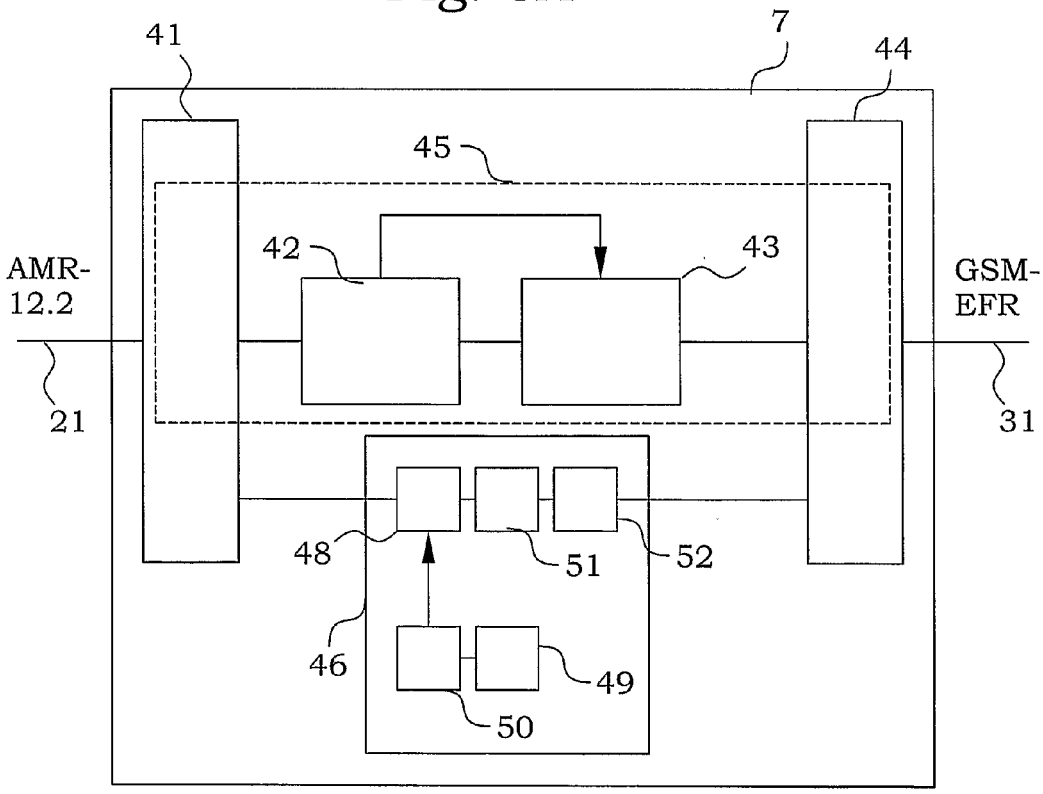
FIG. 6B is a block diagram of main parts of an embodiment of a transcoder from AMR-12.2 to GSM-EFR.

FIG. 6B is a block diagram of main parts of an embodiment of a transcoder 7 from AMR-12.2 to GSM-EFR. Frames encoded according to the AMR-12.2 coding scheme are received at an input 21. Most parts of the transcoder 7 are similar to the ones in the transcoder 6 of FIG. 6A, and are not further discussed. However, the frames intended to be considered as being encoded according to GSM-EFR are transmitted on an output 31.

The SID converter 46 of the speech transcoder 7 is arranged for converting AMR-12.2 SID frames to GSM-EFR SID frames. An AMR-12.2 SID_FIRST frame is converted to a first GSM-EFR SID frame. The SID converter 46 stores received SID parameters from an AMR SID_UPDATE frame in the storage 48, the SID converter also stores decoded SID parameters resulting from a received AMR SID_FIRST frame. A TAF state machine 49 keeps a local TAF state. A control section 50 uses the TAF state of the TAF state machine 49 to determine when a new GSM-EFR SID frame is to be sent from the SID converter 46. The control section 50 initiates a retrieval of the stored SID parameters from the storage to an estimator 51, where SID parameters, such as energy values and the LSFs are estimated. The estimated SID parameters are forwarded to a quantizer 52 arranged to quantize the latest SID parameters to be included in a new GSM-EFR SID frame The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

REFERENCES

U.S. patent application 2003/0177004.
U.S. Pat. No. 6,260,009.
3GPP/TS-26.071
3GPP/TS-06.51

The invention claimed is:

1. Method for speech transcoding from a first speech coding scheme to a second speech coding scheme using similar core compression schemes for speech frames, comprising the steps of:

utilizing speech frames of said first speech coding scheme as speech frames of said second speech coding scheme, wherein said first speech coding scheme and said second speech coding scheme have a same sub-frame structure and are bit stream compatible for frames comprising coded speech;

identifying an occurrence of state mismatch in an energy parameter between said first speech coding scheme and said second speech coding scheme; and adjusting said energy parameter following said occurrence of state mismatch.

2. Method according to claim 1, wherein said step of adjusting comprises adjusting said energy parameter in at least one frame following said occurrence of state mismatch in frames of said second speech coding scheme.

3. Method according to claim 1, wherein said core compression schemes of said first speech coding scheme and said second speech coding scheme are bit stream compatible for frames containing coded speech.

4. Method according to claim 1, wherein said step of identifying comprises the step of determining an occurrence of a predetermined speech evolution.

5. Method according to claim 4, wherein said predetermined speech evolution is a speech type transition.

6. Method according to claim 5, wherein said predetermined speech evolution is an onset of speech following a period of speech inactivity.

7. Method according to claim 1, wherein said step of identifying in turn comprises the steps of:

decoding a first energy parameter of speech encoded by said first speech coding scheme;

decoding of a second energy parameter of said speech using said second speech coding scheme; and comparing said first energy parameter and said second energy parameter.

8. Method according to claim 1, wherein said step of adjusting comprises the step of changing said energy parameter by a predetermined factor.

9. Method according to claim 8, wherein said predetermined factor is a predetermined factor in the index domain.

10. Method according to claim 8, wherein said step of adjusting comprises the step of changing said energy parameter according to a comparison between said first energy parameter of speech encoded by said first speech coding scheme and said second energy parameter of speech encoded by said second speech coding scheme.

11. Method according to claim 1, wherein said step of adjusting is performed for the first n subframe after said occurrence of state mismatch, where n>0.

12. Method according to claim 10, wherein said step of adjusting is performed continuously for every subframe until said state mismatch is negligible.

13. Method according to claim 1, wherein said step of adjusting comprises the step of changing said energy parameter based on an estimate based on comfort noise energy during frames preceding said occurrence of state mismatch.

14. Method according to claim 1, wherein said step of adjusting comprises the step of changing a quantization state of said energy parameter based on external energy information.

15. Method according to claim 1, comprising the further step of converting silence description parameters in silence description frames of said first speech coding scheme to silence description parameters in silence description frames of said second speech coding scheme.

16. Method according to claim 1, wherein said first speech coding scheme is GSM-EFR and said second speech coding scheme is AMR-12.2.

17. Method according to claim 16, wherein said step of adjusting comprises the step of reducing said energy parameter index by a factor $2^n$, where n is an integer >0.

18. Method according to claim 16, wherein said step of adjusting comprises the step of setting said energy parameter to zero, whereby said first subframe after said occurrence of state mismatch is suppressed.

19. Method according to claim 16, comprising the step of:

converting a first GSM-EFR silence description frame to an AMR SID_FIRST frame.

20. Method according to claim 19, comprising the further step of:

utilizing silence description parameters of a latest received GSM-EFR silence description frame as a basis for silence description parameters of an AMR SID_UPDATE frame, whenever an AMR SID_UPDATE frame is to be sent.

21. Method according to claim 20, comprising the further step of:

filtering an energy parameter of said AMR SID_UPDATE frame.

22. Method according to claim 1, wherein said first speech coding scheme is AMR-12.2 and said second speech coding scheme is GSM-EFR.

23. Method according to claim 22, comprising the step of:

converting an AMR SID_FIRST frame to a first GSM-EFR silence description frame.

24. Method according to claim 23, wherein the step of converting in turn comprises the steps of:

estimating silence descriptor parameters for an incoming AMR SID_FIRST frame; and quantizing said estimated silence descriptor parameters into a first GSM-EFR silence description.

25. Method according to claim 23, comprising the further step of:

storing received silence description parameters from an AMR SID_UPDATE frame;

keeping a local TAF state;

determining when a new GSM-EFR silence description frame is to be sent from said TAF state;

quantizing the latest of said stored received silence description parameters to be included in said new GSM-EFR silence description frame.

26. Speech transcoder, transcoding frames from a first speech coding scheme to a second speech coding scheme using similar core compression schemes for speech frames, comprising:

means for utilizing speech frames of said first speech coding scheme as speech frames of said second speech coding scheme, wherein said first speech coding scheme and said second speech coding scheme have a same sub-frame structure and are bit stream compatible for frames comprising coded speech;

means for identifying an occurrence of state mismatch in an energy parameter between said first speech coding scheme and said second speech coding scheme; and means for adjusting said energy parameter following said occurrence of state mismatch, connected to said means for identifying.

27. Speech transcoder according to claim 26, wherein said means for adjusting is arranged for adjusting said energy parameter in at least one frame following said occurrence of state mismatch in frames of said second speech coding scheme.

28. Speech transcoder according to claim 26, wherein said core compression schemes of said first speech coding scheme and said second speech coding scheme are bit stream compatible for frames containing coded speech.

29. Speech transcoder according to claim 26, wherein said means for identifying comprises the means for determining an occurrence of a predetermined speech evolution.

30. Speech transcoder according to claim 29, wherein said predetermined speech evolution is a speech type transition.

31. Speech transcoder according to claim 30, wherein said predetermined speech evolution is an onset of speech following a period of speech inactivity.

32. Speech transcoder according to claim 26, wherein said means for identifying in turn comprises:

decoder of a first energy parameter of speech encoded by said first speech coding scheme;

decoder of a second energy parameter of said speech using said second speech coding scheme; and comparator, connected to said decoder of said first energy parameter and said decoder of said second energy parameter, for comparing said first energy parameter and said second energy parameter.

33. Speech transcoder according to claim 26, wherein said means for adjusting comprises means for changing said energy parameter by a predetermined factor.

34. Speech transcoder according to claim 33, wherein said predetermined factor is a predetermined factor in the index domain.

35. Speech transcoder according to claim 32, wherein said means for adjusting is arranged for changing said energy parameter according to a comparison between said first energy parameter of speech encoded by said first speech coding scheme and said second energy parameter of speech encoded by said second speech coding scheme.

36. Speech transcoder according to claim 33, wherein said means for adjusting is arranged to influence a first subframe after said occurrence of state mismatch.

37. Speech transcoder according to claim 35, wherein said means for adjusting is arranged for operating continuously for every subframe until said state mismatch is negligible.

38. Speech transcoder according to claim 26, wherein said means for adjusting comprises means for estimating an energy parameter based on comfort noise energy during frames preceding said occurrence of state mismatch and means for changing said energy parameter based on said estimate.

39. Speech transcoder according to claim 26, further comprising means for converting silence description parameters in silence description frames of said first speech coding scheme to silence description parameters in silence description frames of said second speech coding scheme.

40. GSM-EFR to AMR-12.2 speech transcoder according to claim 26.

41. GSM-EFR to AMR-12.2 speech transcoder according to claim 40, wherein said means for adjusting is arranged for reducing said energy parameter index by a factor $2^n$, where n is an integer >0.

42. GSM-EFR to AMR-12.2 speech transcoder according to claim 40, wherein said means for adjusting is arranged for setting said energy parameter to zero, whereby said first subframe after said occurrence of state mismatch is suppressed.

43. GSM-EFR-to-AMR 12.2 speech transcoder according to claim 40, comprising means for converting a first GSM-EFR silence description frame to an AMR SID_FIRST frame.

44. GSM-EFR-to-AMR 12.2 speech transcoder according to claim 43, further comprising means for utilizing silence description parameters of a latest received GSM-EFR silence description frame as a basis for silence description parameters of an AMR SID_UPDATE frame, whenever an AMR SID_UPDATE frame is to be sent.

45. GSM-EFR-to-AMR 12.2 speech transcoder according to claim 44, comprising a filter for an energy parameter of said AMR SID_UPDATE frame.

46. AMR 12.2-to-GSM-EFR speech transcoder according to claim 26.

47. AMR 12.2-to-GSM-EFR speech transcoder according to claim 46, comprising means for converting an AMR SID_FIRST frame to a first GSM-EFR silence description frame.

48. AMR 12.2-to-GSM-EFR speech transcoder according to claim 47, wherein said means for converting is arranged to estimate silence descriptor parameters for an incoming AMR SID_FIRST frame and to quantize said estimated silence descriptor parameters into a first GSM-EFR silence description.

49. AMR 12.2-to-GSM-EFR speech transcoder according to claim 47, further comprising:

storage of received silence description parameters from an AMR SID_UPDATE frame;

means for keeping a local TAF state;

means for determining when a new GSM-EFR silence description frame is to be sent from said TAF state;

means for quantizing the latest of said stored received silence description parameters to be included in said new GSM-EFR silence description frame.

50. Telecommunication system comprising a speech transcoder according to claim 26.

* * * * *